US006900404B2

(12) United States Patent
Searle et al.

(10) Patent No.: US 6,900,404 B2
(45) Date of Patent: May 31, 2005

(54) SWITCH ASSEMBLY AND METHOD OF GUIDING A PUSH BUTTON SWITCH IN A SWITCH HOUSING

(75) Inventors: Gary M. Searle, Norfolk, MA (US); Christopher Blake, Swansea, MA (US)

(73) Assignee: Stoneridge Control Devices, Inc., Canton, MA (US)

( * ) Notice: Subject to any disclaimer, the term of this patent is extended or adjusted under 35 U.S.C. 154(b) by 0 days.

(21) Appl. No.: 10/638,964

(22) Filed: Aug. 11, 2003

(65) Prior Publication Data

US 2004/0140190 A1 Jul. 22, 2004

Related U.S. Application Data

(60) Provisional application No. 60/402,502, filed on Aug. 9, 2002.

(51) Int. Cl.[7] ..... H01H 13/00

(52) U.S. Cl. ..... 200/341; 200/345; 200/520

(58) Field of Search ..... 200/5 R, 17 R, 200/18, 310–317, 329, 520, 529, 339, 341–345

(56) References Cited

U.S. PATENT DOCUMENTS

| | | | | | |
|---|---|---|---|---|---|
| 5,201,824 | A | * | 4/1993 | Kato et al. | 200/520 |
| 5,285,038 | A | * | 2/1994 | Asher et al. | 200/314 |
| 5,399,820 | A | * | 3/1995 | Silfvast | 200/314 |
| 5,941,373 | A | * | 8/1999 | Cheng | 200/344 |
| 6,102,394 | A | * | 8/2000 | Wurz et al. | 273/138.2 |
| 6,242,705 | B1 | * | 6/2001 | Huang | 200/520 |

* cited by examiner

*Primary Examiner*—Michael A. Friedhofer
(74) *Attorney, Agent, or Firm*—Grossman, Tucker, Perreault & Pfleger, PLLC

(57) ABSTRACT

A push button switch including a housing and a push button body disposed at least partially within the housing. The push button body may include a base portion and at least one guide portion extending from the base portion. The housing may include at least one mating guide portion for receiving the least one guide portion of the button body and guiding the translation of the button body in the housing. A rocker may be positioned between the push button body and a contact closure, and the push button body may pivot the rocker about a pivot point upon depression of the head thereby changing a state of the contact closure. A light source may be positioned beneath the rocker and for illuminating a bottom of the button head.

22 Claims, 9 Drawing Sheets

SWITCH ASSEMBLY AND METHOD OF GUIDING A PUSH BUTTON SWITCH IN A SWITCH HOUSING

CROSS-REFERENCE TO RELATED APPLICATIONS

The present application claims the benefit of the filing date of U.S. Provisional Application Ser. No. 60/402,502, filed Aug. 9, 2002, the teachings of which are incorporated herein by reference.

FIELD OF THE INVENTION

The present invention relates generally to switches, and, more particularly, to a switch including a push button.

BACKGROUND

Push button switches are used in a wide variety of applications. Such switches generally include a push button disposed within a housing. The push button may be depressed to cause movement of the push button relative to the housing for directly or indirectly changing the state of an electrical contact, i.e. opening or closing the contact.

Typically, the aspect ratio of the push button is used to provide guidance during translation of the push button in the housing. The aspect ratio is defined as the push button width, or largest dimension of the push button footprint, divided by the length of engagement of the push button into the housing. Using this approach, to properly guide a wide push button the button must be long. This results in a high profile switch.

The profile of the switch may, however, may be limited by the application. For example, design considerations in automotive instrument panels can limit the aspect ratio of the switch. Also, the required aspect ratio may be impractical due to increased cost and manufacturing limitations, e.g. injection molding limitations. Known switches are also susceptible to sticking of the push button relative to the housing caused by contamination and galling. To address this, grease is typically applied on the guide surfaces between the housing and push button.

Accordingly, there is a need for switch assembly and method of guiding push button switch in a housing that avoids aspect ratio limitations of the prior art while allowing reliable and facile switch operation.

SUMMARY OF THE INVENTION

According to one aspect of the invention, there is provided a push button switch including a housing and a push button body disposed at least partially within the housing. The push button body may include a base portion and at least one guide portion extending from the base portion. The housing may include at least one mating guide portion for receiving the least one guide portion of the button body and guiding translation of the button body in the housing. According to another aspect of the invention there is provided a push button switch including a housing; a push button body disposed at least partially within the housing; and a separate button head affixed to the button body by corresponding latch features on the button head and the button body.

A switch consistent with the invention may also include a rocker positioned between the push button body and a contact closure. The push button body may be configured to pivot the rocker about a pivot point upon depression of a button head thereby changing a state of the contact closure.

The pivot point of the rocker may be disposed outside of a perimeter of the button head. The rocker may include a base portion and first and second arms extending from the base portion. The first and second arms may be configured to interlock with arms of a second rocker associated with an adjacent switch.

A light source may be positioned beneath the rocker for illuminating a bottom of the button head, and may be aligned with a center line of the button body. The rocker, button body and housing may include aligned openings to allow light from the light source to project therethrough, e.g. onto a button head.

BRIEF DESCRIPTION OF THE DRAWINGS

For a better understanding of the present invention, together with other objects, features and advantages, reference should be made to the following detailed description which should be read in conjunction with the following figures wherein like numerals represent like parts.

DETAILED DESCRIPTION

For simplicity and ease of explanation, the present invention will be described herein in connection with various exemplary embodiments thereof. Those skilled in the art will recognize, however, that the features and advantages of the present invention may be implemented in a variety of configurations. It is to be understood, therefore, that the embodiments described herein are presented by way of illustration, not of limitation.

Figure 1:
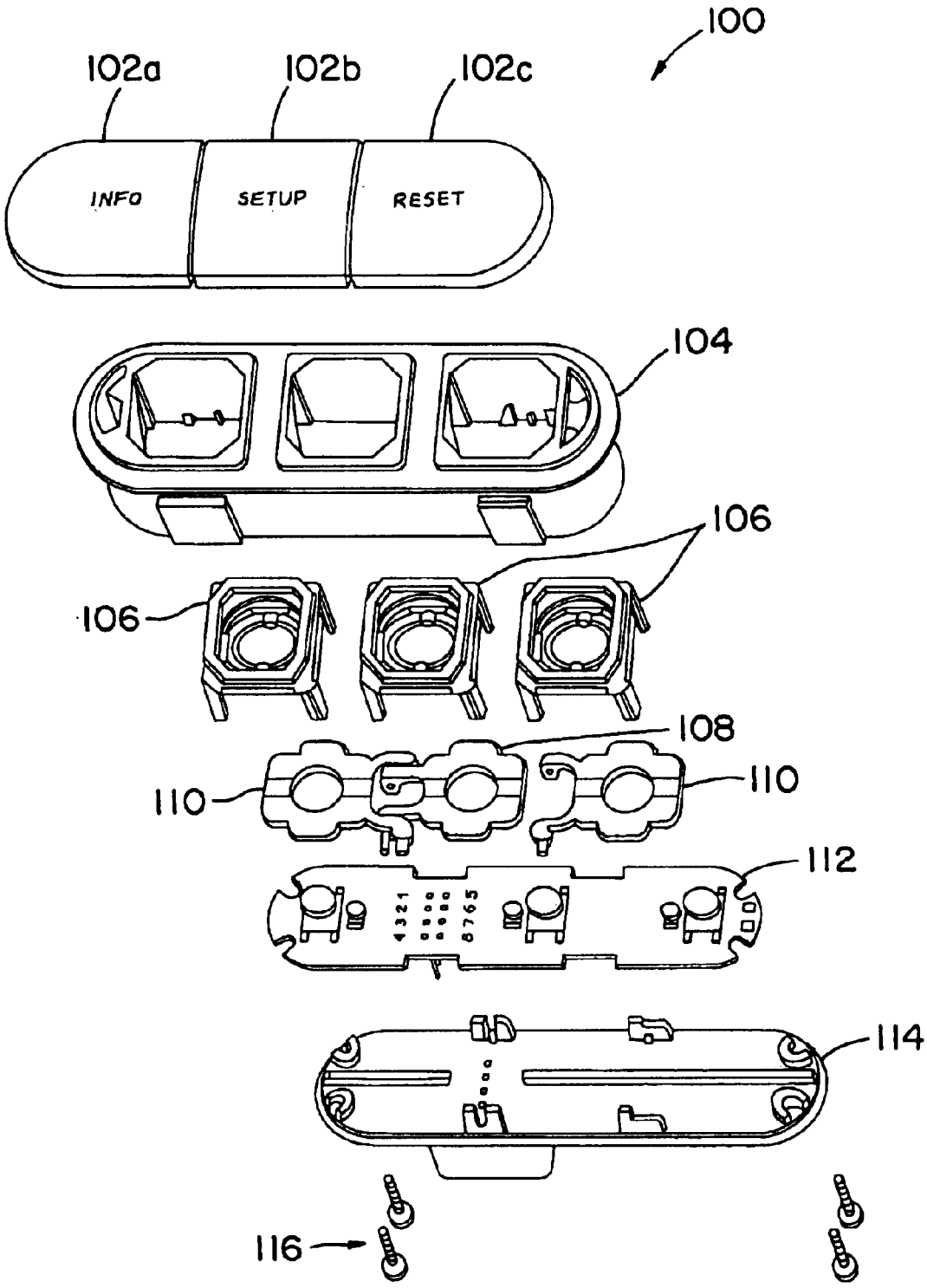
FIG. 1 is an exploded view of an exemplary switch assembly consistent with the invention.

Turning now to FIG. 1, there is provided an exploded view of one exemplary switch 100 consistent with the invention. The illustrated exemplary switch includes: one or more button heads 102*a*, 102*b*, 102*c*; a button housing 104; a button body 106 associated with each of the button heads

102*a*, 102*b*, 102*c*; an inner 108 or outer 110 rocker associated with each of the button bodies; a printed circuit board (PCB) 112 including contact closure means, such as a micro switch, associated with each of the button bodies; a base 114; and fasteners, such as screws 116, for securing the PCB to the base. In general, the button bodies 106 are positioned within the housing above associated rockers 108,110. When a button head 102*a*, 102*b* and/or 102*c* is depressed by a user, the button body positioned beneath the button head moves downward in the housing against an associated rocker 108 or 110. The rocker pivots about a pivot point to change the state of a switch, e.g. through contact with a micro switch on the PCB.

Figure 2:
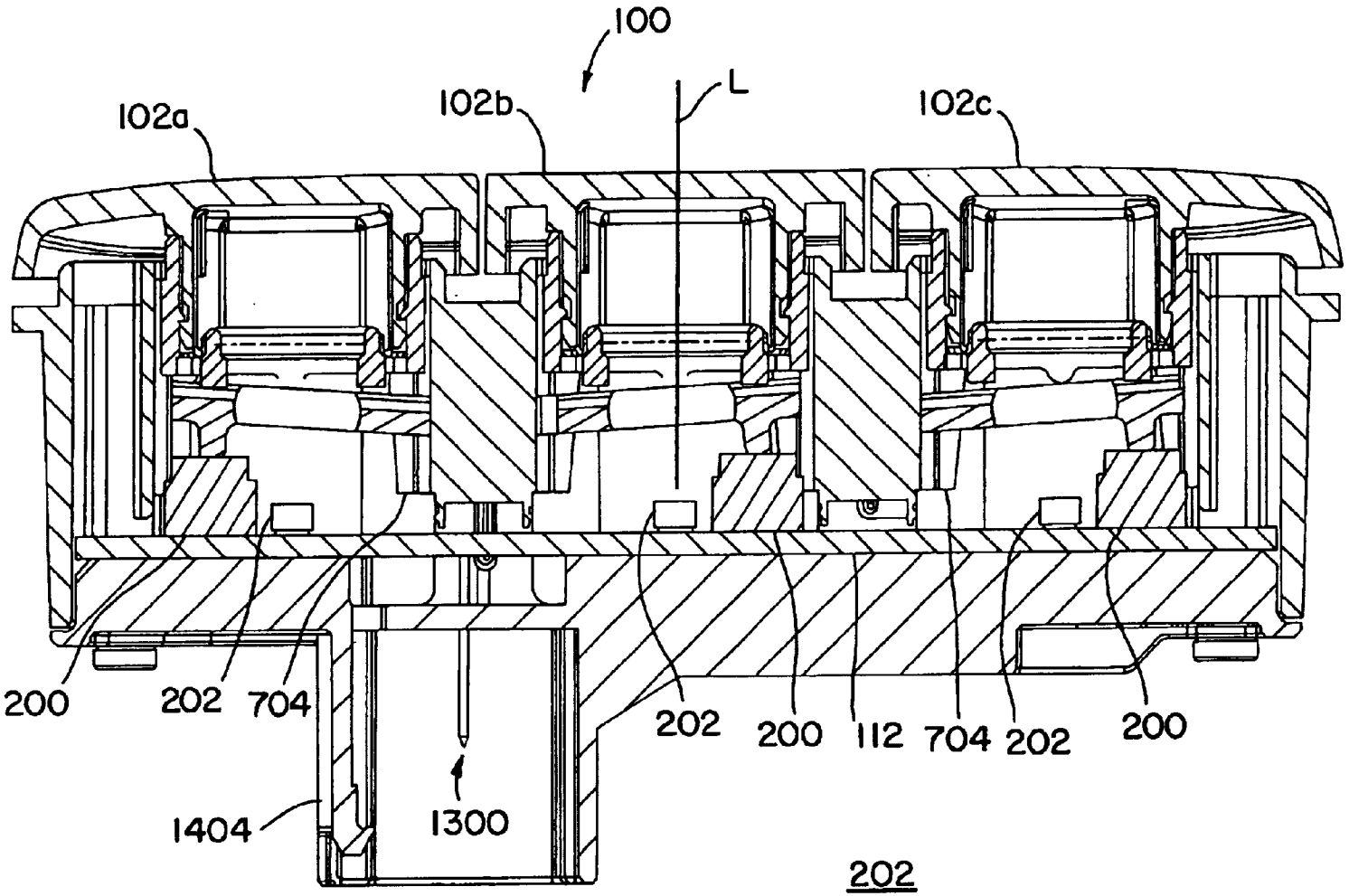
FIG. 2 is a sectional view of the switch assembly illustrated in FIG. 1.

FIG. 2 is a lengthwise cross-section view of the switch illustrated in FIG. 1. In the illustrated exemplary embodiment, the PCB 112 includes a momentary micro switch 200 associated with each of the button heads 102*a*, 102*b*, 102*c*. Those skilled in the art will recognize, however, that a variety contact closure means may be used in a switch consistent with the invention. For example, the contact closure means may be a stamped contact on the PCB. The stamped contact may include a contact beam for contacting the associated rocker and providing a preload to the rocker. A latching micro switch could also be used, and a momentary micro switch could be used with a latching relay. In fact, the contact closure means may include any mechanism for changing electrical contact or electrical state of a circuit.

Figure 5:
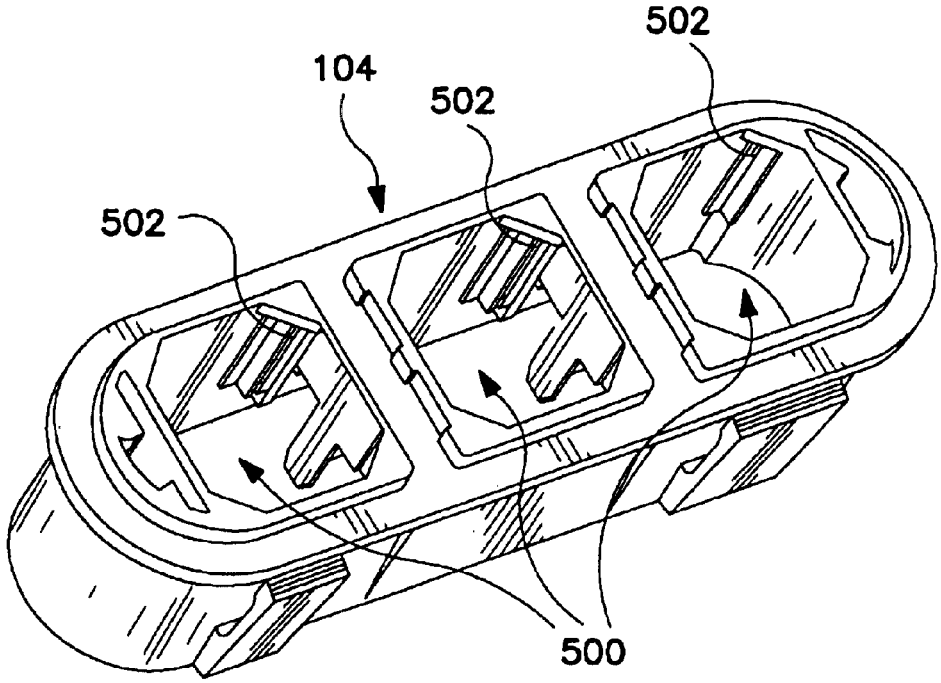
FIG. 5 is a top perspective view of an exemplary button head housing consistent with the present invention.
Figure 13:
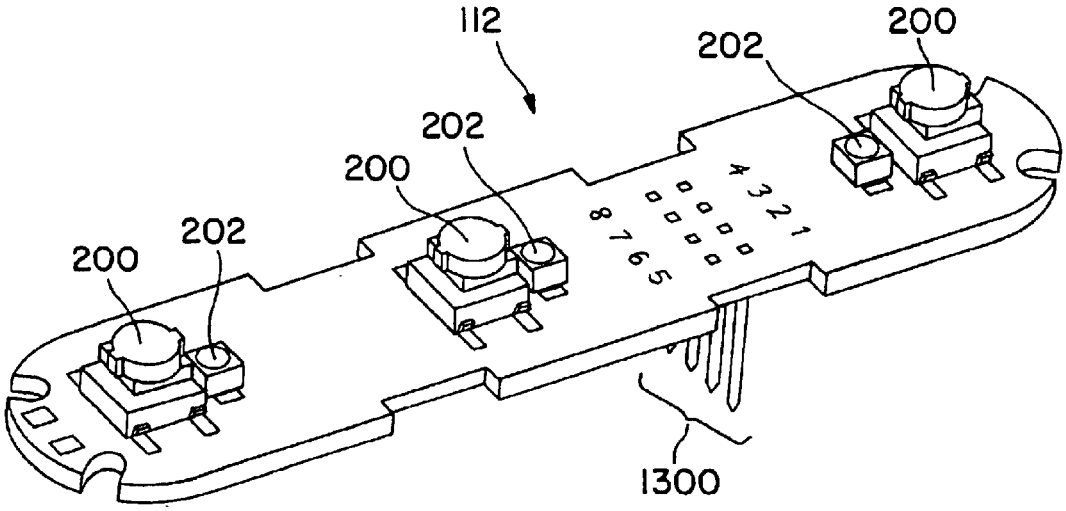
FIG. 13 is a top perspective view of an exemplary switching circuit board consistent with the present invention.
Figure 14:
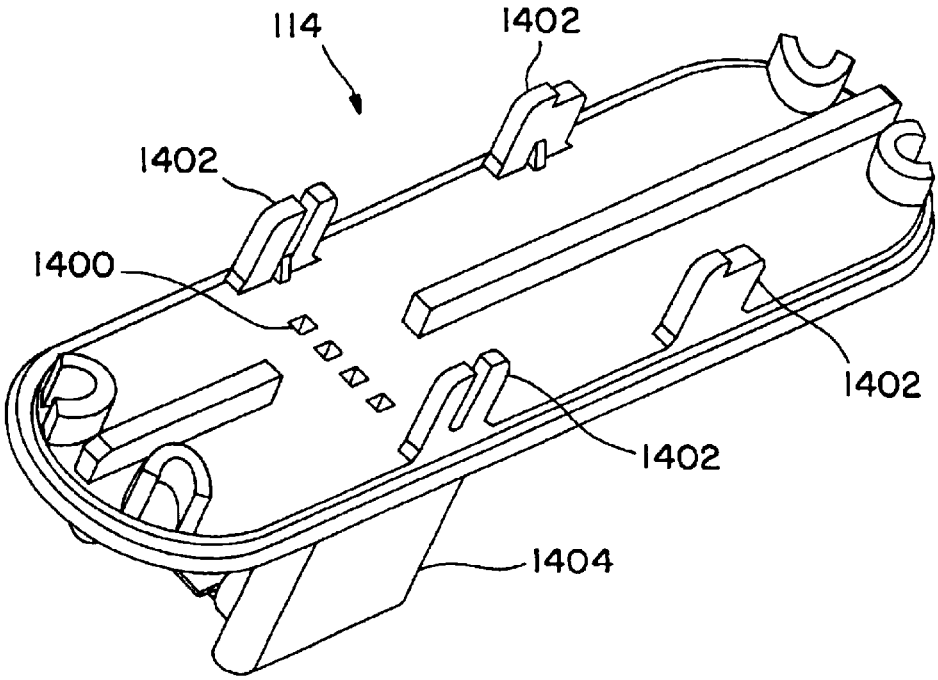
FIG. 14 is a top perspective view of an exemplary switch base consistent with the present invention.

With reference also to FIGS. 13 and 14, traces on the PCB 112 connect the micro switches to associated output leads 1300 extending from the back of the PCB 112. The pins 1300 may be positioned to extend through corresponding openings 1400 in the base, which may include an integral connector 1404 for connecting the pins to an electrical system, e.g. an automotive electrical system. The pins may also include a power input pin for providing electrical input to components on the PCB. For example a light source, e.g. a light emitting diode (LED), may be provided on the PCB under each button head for illuminating the button head. To accommodate illumination of the button heads by the light sources, the light sources 202 may be positioned along a center line, e.g. line L, of the button body 106 with the micro switches 200 positioned off-center, as shown. The housing 104, button bodies 106 and rockers 108,110 may include aligned central openings 500, 700, 900 (FIGS. 5, 7 and 9), respectively, for allowing light from the light source project onto the bottom of the button heads 102*a*, 102*b*, 102*c*.

Figure 4:
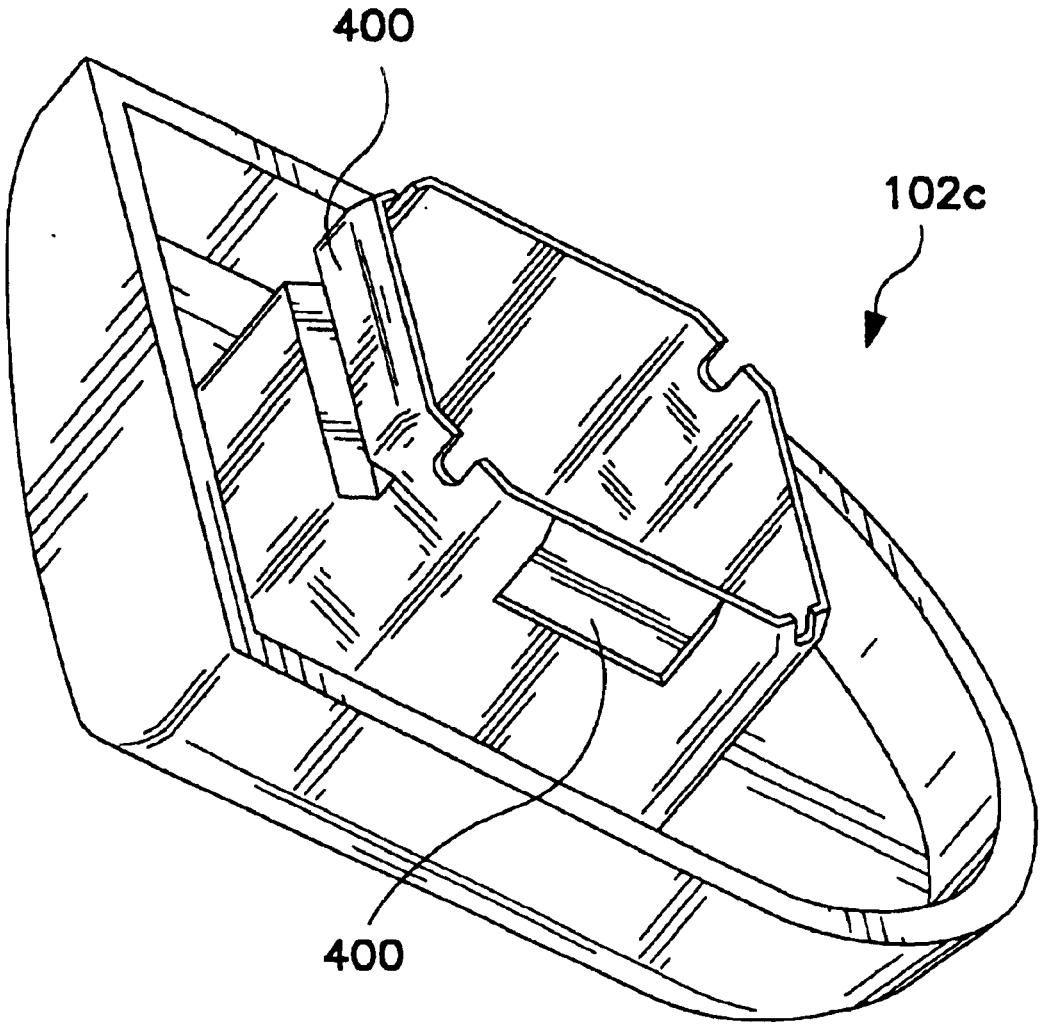
FIG. 4 is a bottom perspective view of an exemplary button head consistent with the present invention.
Figure 7:
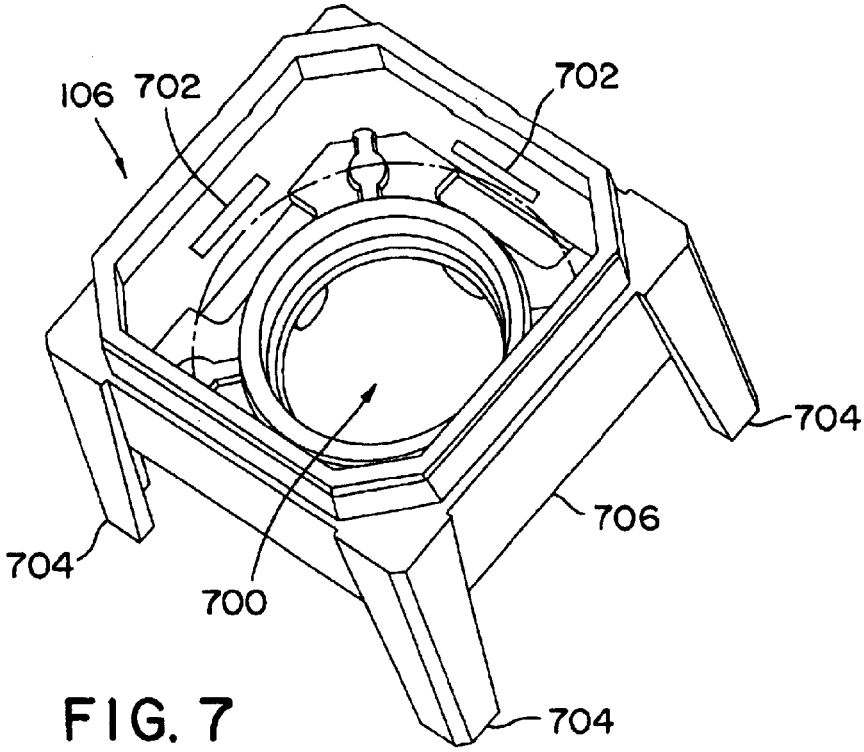
FIG. 7 is a top perspective view of an exemplary button body consistent with the present invention.

In the illustrated embodiment, during the actuation cycle of one or more of the button heads 102*a*, 102*b*, 102*c* the button head and the associated button body 106 translate in the housing 104, and the associated rocker 108,110 pivots to engage and change the state of the associated 200 micro switch. With reference also to FIGS. 4 and 7, the button heads may be affixed to an associated button body by one or more latch features 400 on the button head that mate with corresponding latch features 702 on the button body so that they move in unison. A loose fit between the latch features 400, 702 can produce undesirable noise in some applications, e.g. due to vibration. To minimize the potential for vibratory noise, crush features may be incorporated into either the button head or the button body at the mating surfaces thereof. The crush features may be configured to eliminate any loose fit between the components.

Providing the heads 102*a*, 102*b*, 102*c* and bodies 106 as separate parts that snap together minimizes the effect of manufacturing defects, such as sink marks from molding. Also, the heads may be molded from an expensive polymer that provides desired surface characteristics such as illumination, color, texture and gloss. Separating the head and body into separate components, also reduces the volume expensive polymer required for the switch and reduces the molding cycle to produce the head, resulting in significant cost savings.

With reference also to FIGS. 5–8, each button body 106 may be guided for translation in the housing 104 by four corner guides 704 extending downward from a base portion 706 of the button body 106. The corner guides 704 mate and align with corresponding corners 502 of the housing cavity. The lengths of the corner guides 704 may be selected to provide an optimum aspect ratio for the available switch profile. In the illustrated exemplary embodiment, the corner guides 704 on the button body extend downward toward the PCB and beyond the rockers. The extended corner guides 704 reduce play or loose feel in the button heads during actuation.

The base portion 706 of the button bodies 106 engages the associated rockers 108 or 110, which pivot to engage the micro switch in the illustrated embodiment. The rockers facilitate actuation of micro switches positioned off center from the button heads 102*a*, 102*b*, 102*c* while allowing illumination of the button heads by the LEDs 202, and add to the profile limitations of the switch. It is to be understood, however, that rockers may not be required in non-illuminated switches, switches that incorporate a switch and light source as a single component, membrane switches with alternate low profile lighting sources, etc.

Figure 8:
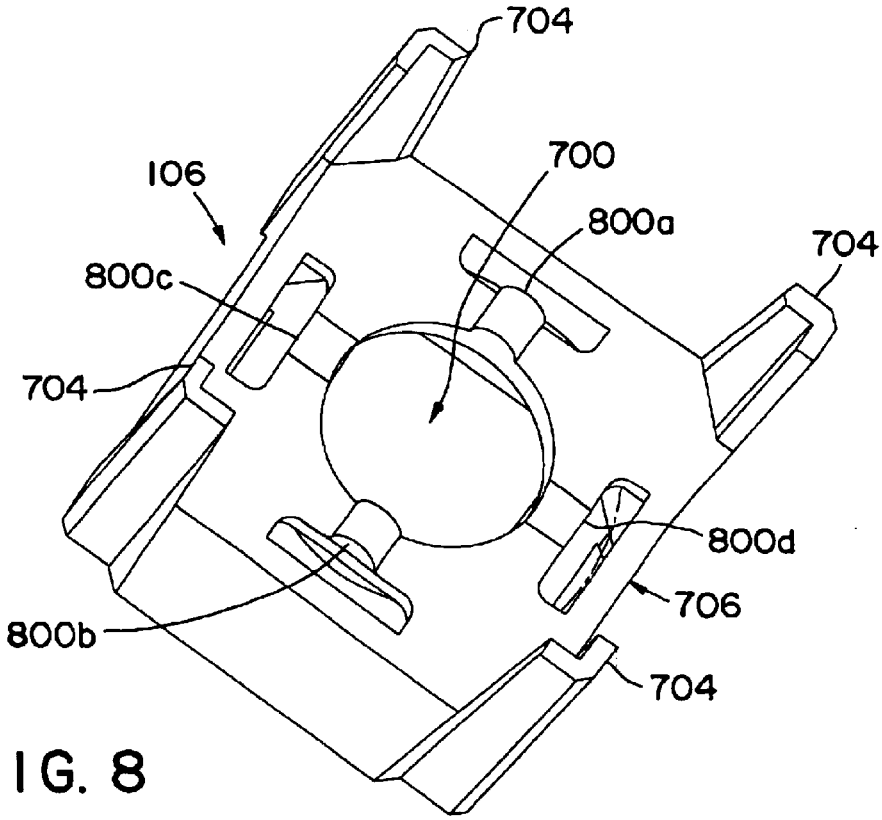
FIG. 8 is a bottom perspective view of the exemplary button body shown in FIG. 7.
Figure 9:
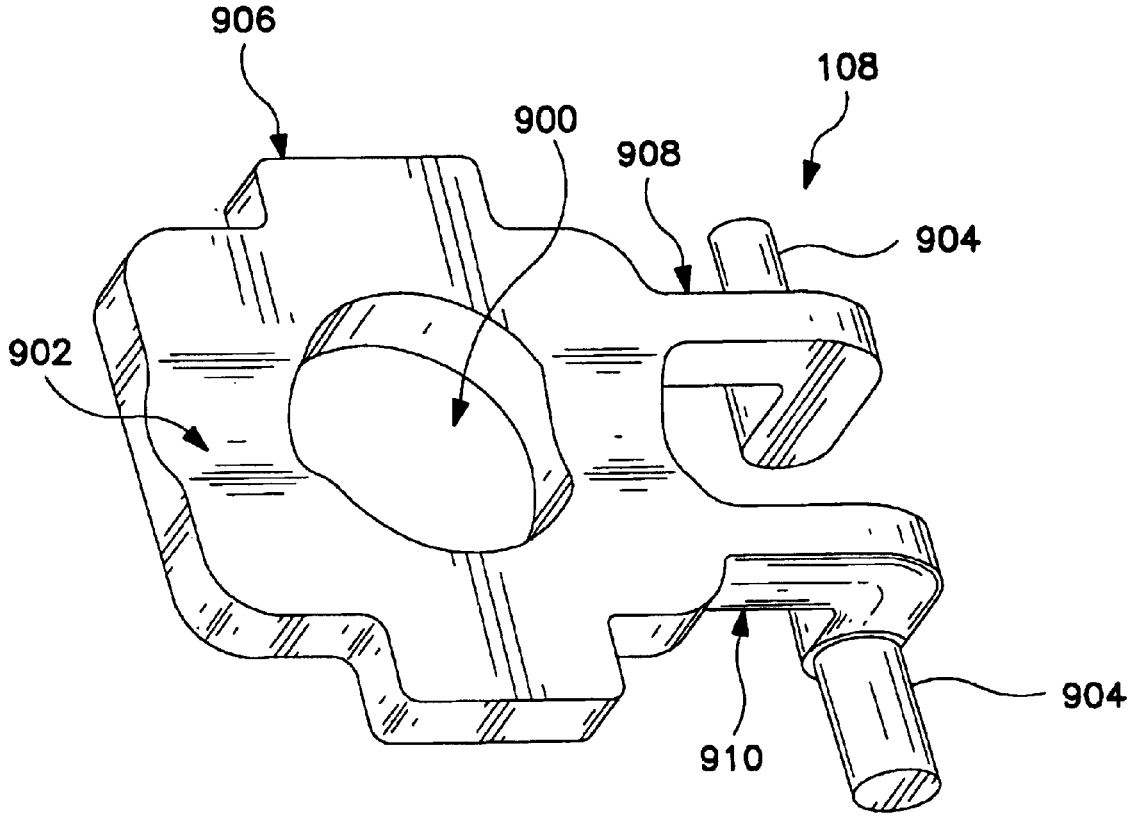
FIG. 9 is a top perspective view of an exemplary inner rocker consistent with the present invention.

Advantageously, the button bodies 106 may be symmetrically configured to allow assembly in an associated housing cavity portion in any of four orientations. With particular reference to FIG. 8, for example, four hemispherical contact features 800*a*, 800*b*, 800*c*, 800*d* may be equally spaced around the perimeter of bottom of the base 706 of the button body. When the switch is assembled, a pair 800*a* and 800*b*, or 800*c* and 800*d*, of the hemispherical features form a line of contact with an associated rocker. This reduces tactile feel variation by maintaining a single line of contact between the button body and the rocker through out the button head actuation cycle. With reference to FIG. 9, a groove 902 or other clearance feature may be provided in the rocker 108,110 for receiving the two non-contacting hemispherical contact features so that they do not interfere with the rocker during actuation.

Figure 6:
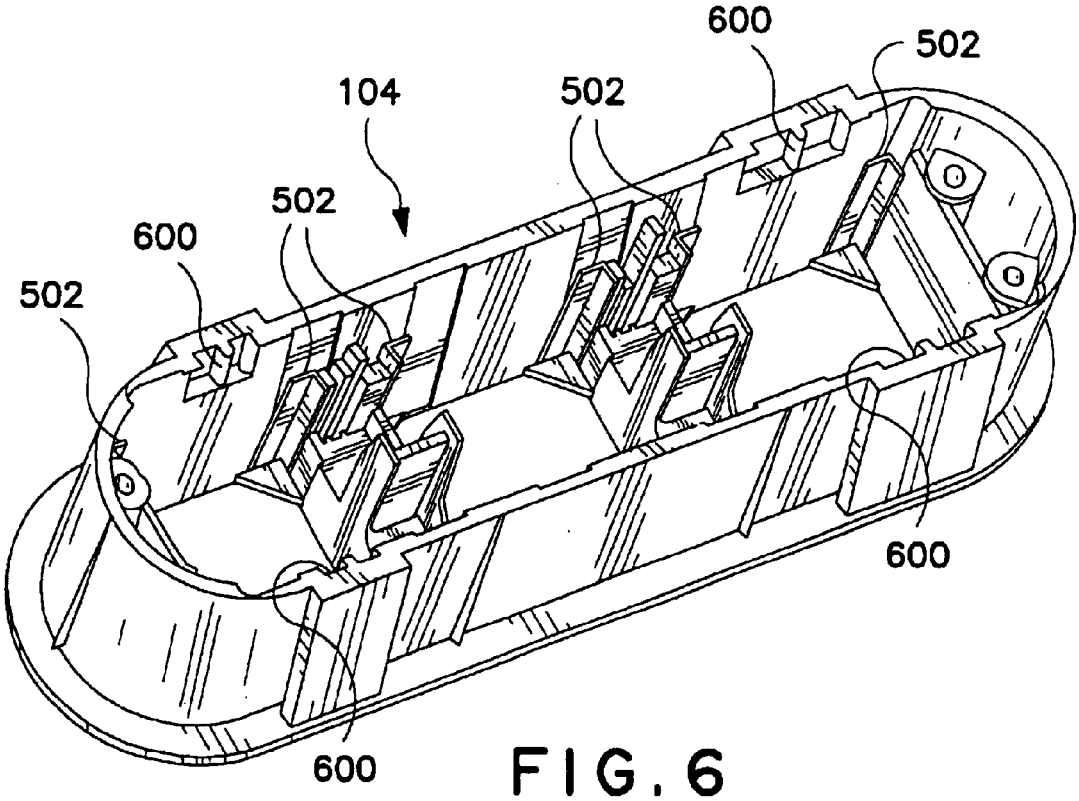
FIG. 6 is a bottom perspective view of the button head housing shown in FIG. 5.

In the illustrated embodiment, the rockers include a contact projection on the bottom thereof 1000 and two outwardly extending pivot shafts 904. The rocker is preloaded against the base 706 of an associated button body with the contact projection 1000 positioned against the top of the associated micro switch 200. The outwardly extending pivot shafts 904 may be supported by features 600, 1402 in the housing and base, as shown in FIGS. 6 and 14, to provide pivot points for the rockers.

Figure 10:
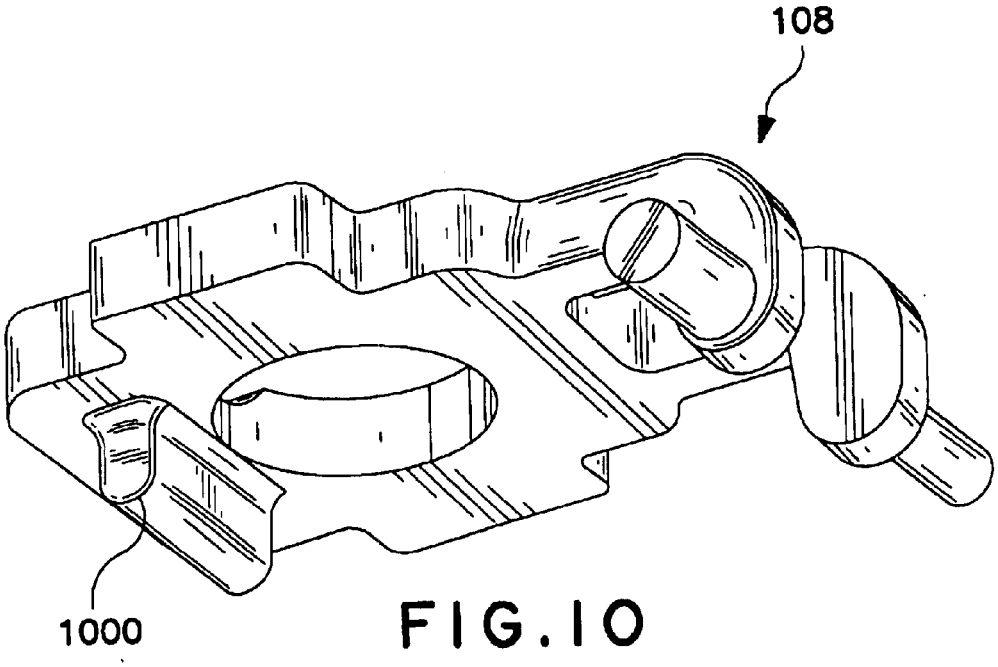
FIG. 10 is a bottom perspective view of the rocker shown in FIG. 9.
Figure 11:
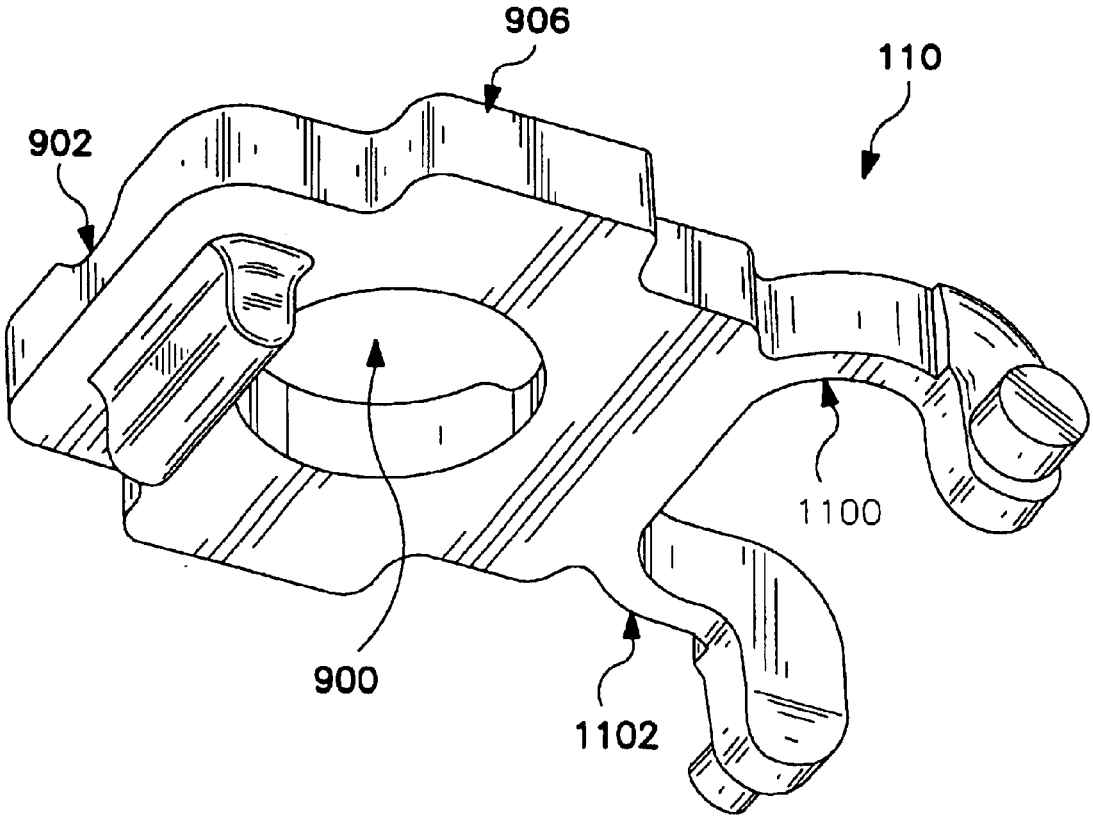
FIG. 11 is a top perspective view of an exemplary outer rocker consistent with the present invention.
Figure 12:
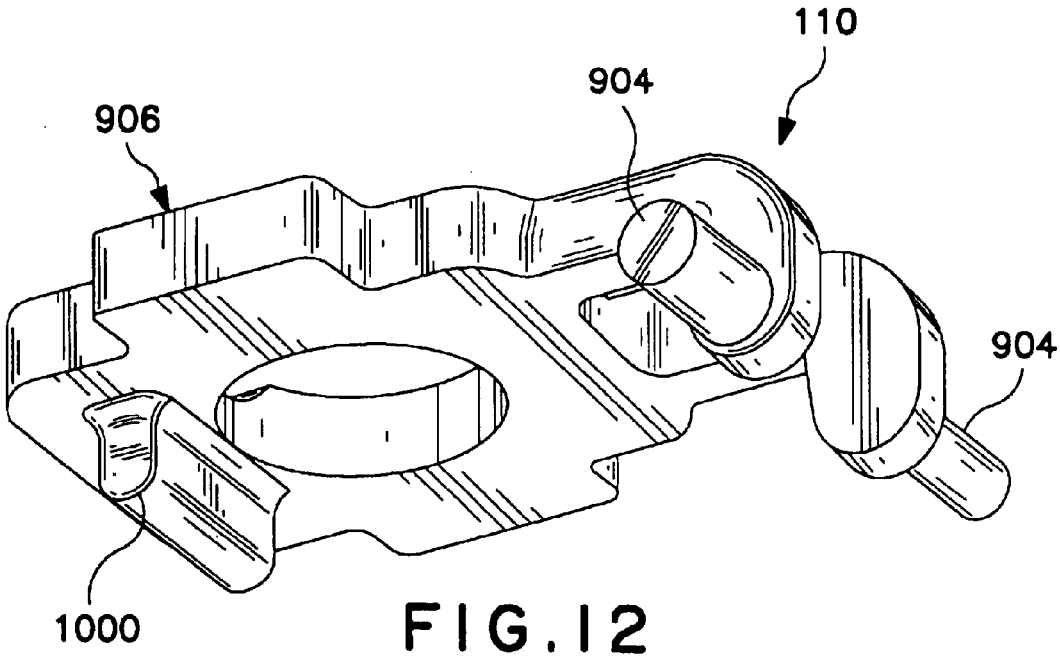
FIG. 12 is a bottom perspective view of the rocker shown in FIG. 11.

In an embodiment with multiple button heads, as shown, inner 108 and outer 110 rocker configurations may be provided. As shown in FIGS. 9–10, the inner rocker 108 may include a body portion 906 and first and second pivot arms 908, 910 that extend from the body 906. The pivot shafts 904 may be provided at the ends of the pivot arms 908, 910, as shown. As shown in FIGS. 11–12, the outer rockers may include a body portion 906 and first and second pivot arms 1100, 1102 configured to interlock with the pivot arms 908, 910 of an inner rocker. As shown in FIG. 1, for example, the pivot arms 908, 910 of the inner rocker extend in a direction generally parallel to the longitudinal axis of the switch and the pivot arms 1100, 1102 of the outer rocker curve outwardly from the rocker body 906 so that the inner surfaces of the pivot arms 1100, 1102 may be placed in a facing relationship to the outer surfaces of the inner pivot arms 908,910.

In an embodiment with three button heads 102*a*, 102*b*, 102*c*, only two of the rockers may be interlocking, as shown. To provide a modular configuration, the remaining rocker may be an outer rocker 110, as shown, or an inner rocker 108. Of course, where a modular configuration is not need or desired, the remaining rocker may have a configuration different from the illustrated inner and outer rockers. For example, the separate pivot arms may be replaced by a solid pivot extension that extends from the body, and the pivot shafts may be provided at the end of the extension.

Figure 3:
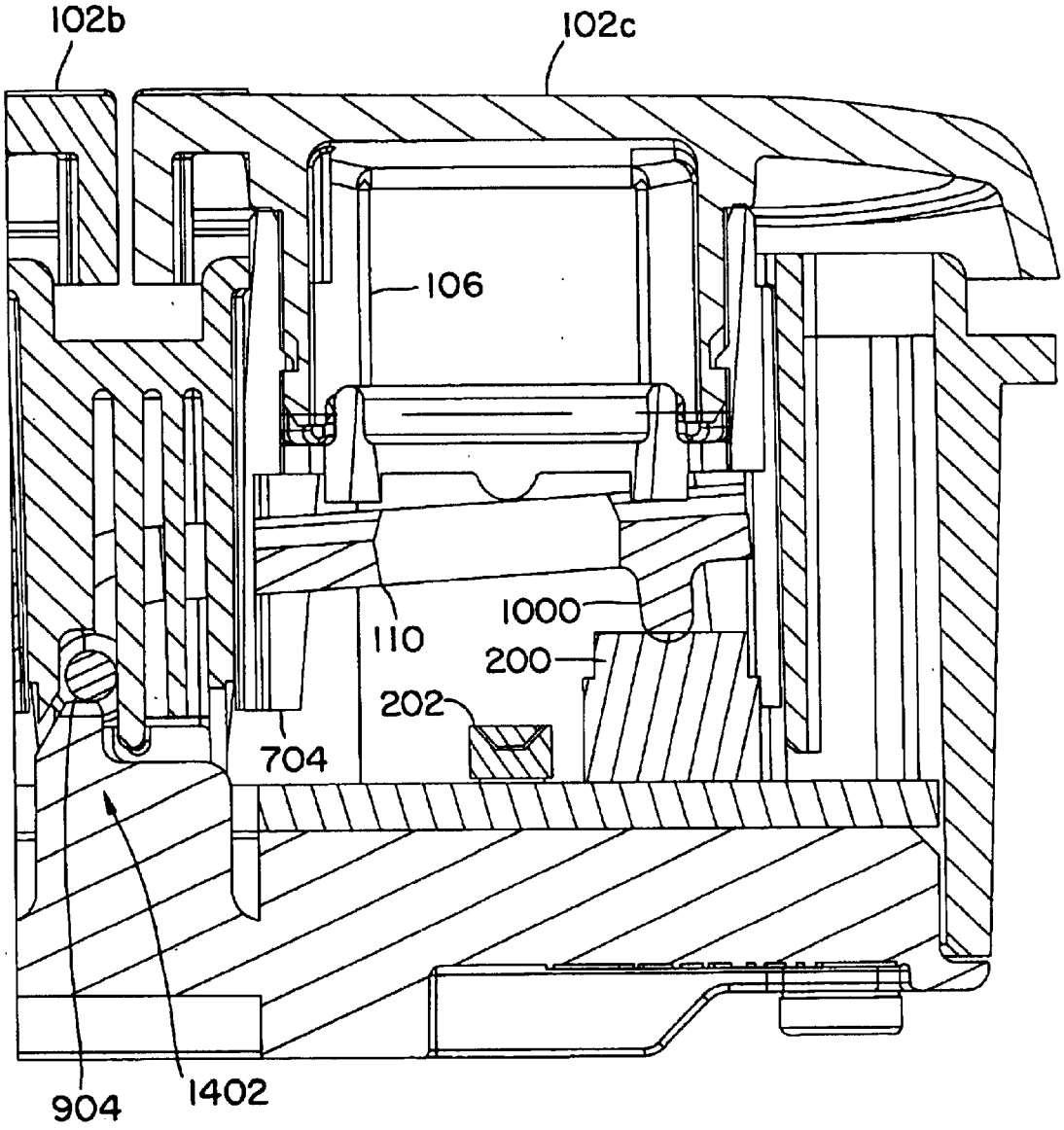
FIG. 3 is a detailed sectional view of an end portion of switch assembly illustrated in FIG. 1.

Advantageously, the pivot point for each rocker 108, 110 may be positioned under the adjacent button head. With reference to FIG. 3, for example, the shaft 904 of the rocker 110 is supported by a support feature 1402 on the base and a corresponding feature 600 in the housing so that it is disposed under the button head 102*b*, not under the button head 102*c* associated with the rocker 110. Since the pivot point of the rocker 110 is not under the associated button head 102*c*, the button head 102*c* and body will not stick when actuated at any point on the entire surface of the button head.

Advantageously, the switch components may be modular so that, for example, all of the components except the button heads 102*a*, 102*b*, 102*c* are common to a family of switches. This allows the components to be assembled in a highly automated process, thereby reducing the cost and manufacturing time of the switch. When a new function is desired for the switch, only the button head needs to be changed to accommodate the new function. The tolerances of the components in a switch consistent with the invention may also be liberal since extensive guide features for the button bodies may be avoided. A switch consistent with the invention also allows use of large button heads without any loss to switch feel during actuation, provided that the base of the button head does not extend to or beyond the pivot point of the rocker. Thus, to accommodate switch profile requirements, the button head can be expanded in any of three directions without sacrificing performance during actuation.

The embodiments that have been described herein, however, are but some of the several which utilize this invention and are set forth here by way of illustration but not of limitation. For example, various features and advantages described herein may be combined or used separately. It is obvious that many other embodiments, which will be readily apparent to those skilled in the art, may be made without departing materially from the spirit and scope of the invention.

What is claimed is:

1. A push button switch comprising:

a housing;

a push button body disposed at least partially within said housing, said push button body comprising a base portion and at least one guide portion extending from said base portion, and wherein said housing includes at least one mating guide portion for receiving said at least one guide portion of said button body and guiding translation of said button body in said housing; and a separate rocker positioned between said push button body and a contact closure, said rocker comprising at least one pivot shaft extending therefrom, said push button body being configured to pivot said rocker about a pivot point established by said pivot shaft upon depression of said head for thereby changing a state of said contact closure.

2. A switch according to claim 1, wherein said push button body comprises at least one guide portion extending from each of a plurality of corners of said base portion, and wherein said housing includes a mating guide portion associated with of said guide portions and guiding said translation of said button body in said housing.

3. A switch according to claim 1, wherein said pivot point is disposed outside of a perimeter of said push button body.

4. A switch according to claim 1, wherein said contact closure is a micro switch.

5. A switch according to claim 1, wherein said base portion of said push button body comprises at least one rocker contact on a bottom thereof for contacting said rocker.

6. A switch according to claim 1, wherein said base portion of said push button body comprises four equally spaced rocker contacts on a bottom surface thereof, and wherein said rocker is positioned to engage first and second ones of said rocker contacts upon depression of said push button body.

7. A switch according to claim 6, wherein said rocker comprises features for receiving third and fourth ones of said rocker contacts to avoid engagement of said third and fourth ones of said rocker contacts with said rocker.

8. A switch according to claim 1, wherein said switch further comprises a light source positioned beneath said rocker and for illuminating a bottom of a button head affixed to said push button body.

9. A switch according to claim 8, wherein said light source is aligned with a center line of said button body.

10. A switch according to claim 8, wherein said light source and said contact closure are disposed on a circuit board.

11. A switch according to claim 1, wherein said switch further comprises a light source, and wherein said rocker, said button body and said housing include aligned openings to allow light from said light source to project onto a bottom of a button head affixed to said push button body.

12. A switch according to claim 1, wherein said rocker comprises a base portion and first and second arms extending from said base portion, said first and second arms being configured to interlock with arms of a second rocker associated with an adjacent switch.

13. A switch according to claim 1, wherein said switch comprises a separate button head affixed to said button body by corresponding latch features on said button head and said button body.

14. A push button switch comprising:

a housing;

a push button body disposed at least partially within said housing;

a separate button head affixed to said button body by corresponding latch features on said button head and said button body; and a separate rocker positioned between said push button body and a contact closure, said rocker comprising at least one pivot shaft extending therefrom, said push button body being configured to pivot said rocker about a pivot point established by said pivot shaft upon depression of said head for thereby changing a state of said contact closure.

15. A switch according to claim 14, wherein said push button body comprises a base portion and at least one guide portion extending from said base portion, and wherein said housing includes at least one mating guide portion for receiving said at least one guide portion of said button body and guiding said translation of said button body in said housing.

16. A switch according to claim 14, wherein said pivot point is disposed outside of a perimeter of said button head.

17. A switch according to claim 14, wherein said switch further comprises a light source positioned beneath said rocker and for illuminating a bottom of said button head.

18. A switch according to claim 14, wherein said rocker comprises a base portion and first and second arms extending from said base portion, said first and second arms being configured to interlock with arms of a second rocker associated with an adjacent switch.

19. A push button switch comprising:

a housing;

a push button body disposed at least partially within said housing, said push button body comprising a base portion having four equally spaced rocker contacts on a bottom surface thereof;

a contact closure; and a rocker positioned between said push button body and said contact closure, said rocker positioned to engage first and second ones of said rocker contacts of said push button body to pivot said rocker about a pivot point upon depression of said push button body thereby changing a state of said contact closure.

20. A switch according to claim 19, wherein said rocker comprises features for receiving third and fourth ones of said rocker contacts to avoid engagement of said third and fourth ones of said rocker contacts with said rocker.

21. A push button switch comprising:

a housing;

a push button body disposed at least partially within said housing, said push button body comprising a base portion;

a contact closure; and a rocker positioned between said push button body and said contact closure, said push button body configured to pivot said rocker about a pivot point upon depression of said push button body thereby changing a state of said contact closure, said rocker comprising a base portion and first and second arms extending from said base portion, said first and second arms being configured to interlock with arms of a second rocker associated with an adjacent switch.

22. A push button switch comprising:

a housing;

a push button body disposed at least partially within said housing; and a separate button head affixed to said button body by corresponding latch features on said button head and said button body, a contact closure; and a rocker positioned between said push button body and said contact closure, said push button body configured to pivot said rocker about a pivot point upon depression of said push button body thereby changing a state of said contact closure, said rocker comprising a base portion and first and second arms extending from said base portion, said first and second arms being configured to interlock with arms of a second rocker associated with an adjacent switch.

* * * * *